United States Patent [19]

Vario

[11] 4,247,073

[45] Jan. 27, 1981

[54] CONCRETE FORM TIE ASSEMBLIES

[76] Inventor: Mike Vario, 7306 El Verano, Buena Park, Calif. 90620

[21] Appl. No.: 957,160

[22] Filed: Nov. 2, 1978

[51] Int. Cl.[2] ..... E04G 17/08

[52] U.S. Cl. ..... 249/38; 249/40; 249/46; 249/190; 249/191; 249/213; 249/216

[58] Field of Search ..... 249/7, 33, 36, 38, 40, 249/46, 47, 190, 191, 192, 213, 216

[56] References Cited

U.S. PATENT DOCUMENTS

| | | | |
|---|---|---|---|
| 2,168,990 | 8/1939 | Hungerford | 249/214 |
| 3,292,893 | 12/1966 | Williams | 249/191 |
| 3,734,453 | 5/1973 | Bailey | 249/40 |
| 3,822,860 | 7/1974 | Lovisa et al. | 249/190 |
| 3,941,346 | 3/1976 | Franc | 249/40 |

*Primary Examiner*—Donald J. Arnold
*Attorney, Agent, or Firm*—William C. Babcock

[57] ABSTRACT

A tie assembly for use in removably supporting plywood sheets or other wall defining materials in fixed spaced relationship to define a form into which concrete may be poured to form a portion of a structure. The tie assembly so operates that portions thereof not embedded in the concrete may be removed for future use after the concrete has set. The plywood sheets after removal and recovery of the outwardly disposed portions of the assembly may be separated from the set concrete wall. The tie assembly is adapted for use with forms defined by new plywood sheets, or forms in which previously used plywood sheets are employed that have bolt holes of relatively large diameter therein.

1 Claim, 4 Drawing Figures

FIG. 1
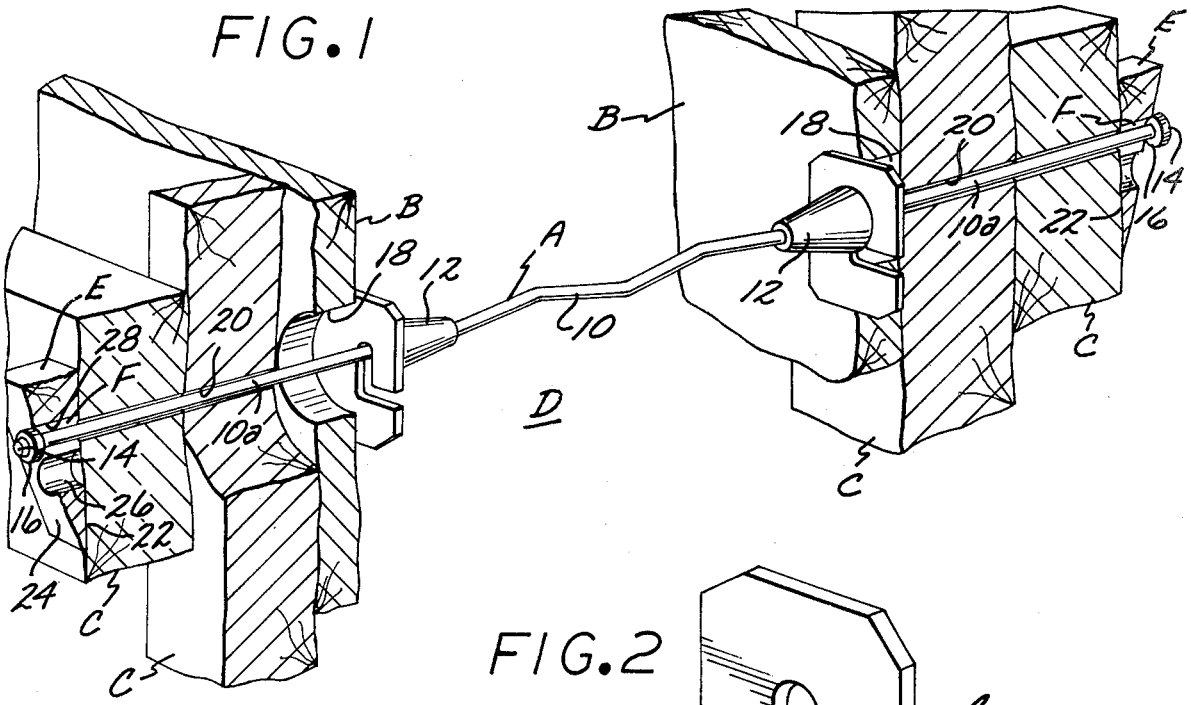
FIG. 2
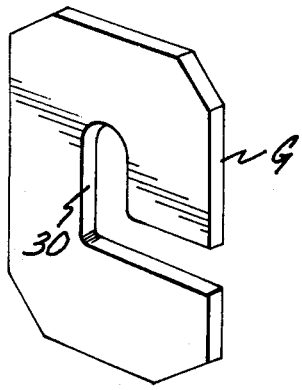
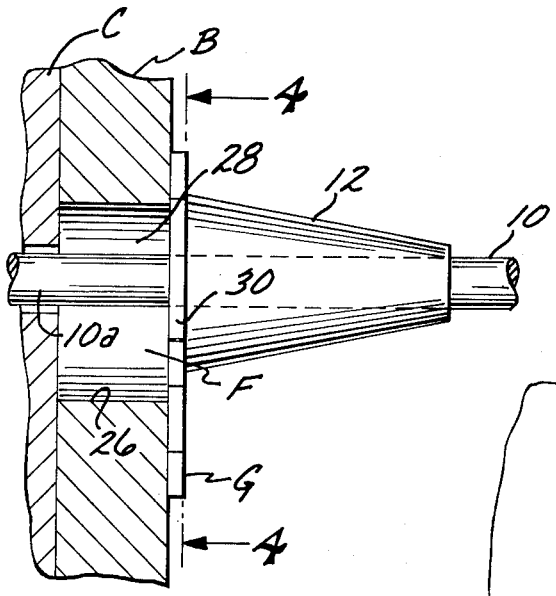
FIG. 3
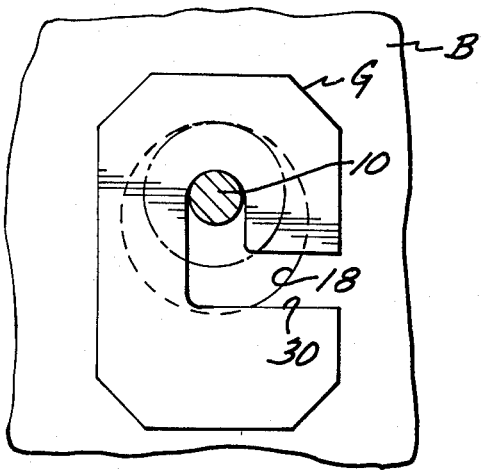
FIG. 4

CONCRETE FORM TIE ASSEMBLIES

BACKGROUND OF THE INVENTION

1. Field of the Invention

Concrete Form Tie Assembly.

2. Description of the Prior Art

In the construction industry it is common practice to use pairs of laterally spaced plywood sheets to define forms into which concrete is poured to define a wall structure. The plywood sheets in the past have been held in fixed lateral spacing by heavy bolts of substantial diameter that extend through axially aligned pairs of opening therein. With the increased cost of steel, the use of heavy bolts to hold the plywood sheets in a form defining position is unduly expensive, as well as time consuming, for after the concrete has set the outwardly disposed nuts must be unscrewed from the bolts to permit the plywood sheets to be separated from the set concrete defining the wall.

A major object of the present invention is to supply a tie assembly that is less expensive to use than bolts in holding plywood sheets in a concrete receiving position to define a form, and one that permits the plywood sheets to be quickly and easily to be separated from the concrete after the latter is set.

Another object of the invention is to furnish a tie assembly that may be used equally successfully with new plywood sheets to define a form, or with previously used plywood sheets that have bolt holes of substantial diameter therein.

SUMMARY OF THE INVENTION

A tie assembly that includes a rod that has two longitudinally spaced stops disposed inwardly from the ends thereof. Two second stops are secured to the ends of the rod. The end portions of the rod are extended through a pair of axially aligned bores in a pair of plywood sheets, with the first pair of stops abutting against the interior surfaces of a pair of plywood sheets that wholly or partially define a concrete form. The assembly includes a pair of triangular wedges formed from a rigid material such as a shell. Each wedge has an elongate flat first surface that may be vertically disposed, and when so disposed a second surface of the wedge extends upwardly and outwardly relative thereto. Each wedge has a key hole shaped transverse opening therein, with a first portion of the opening being of sufficient transverse cross-section as to permit the second stop to be slid therethrough. A second elongate portion of the opening extends upwardly from the first portion, with the second opening portion of greater width than the diameter of the rod. The second opening portion has a width less than the diameter of the second stop. By driving the pairs of wedges downwardly the second surfaces slide downwardly relative to the second stops and force the wedges inwardly for the plywood sheets to be gripped between the wedges and the first stops. The pair of plywood sheets are then held in fixed lateral spacing to define a form into which concrete may be poured. After the concrete has set, the wedges are driven upwardly with the end portions of the rod disposed in the first portions of the openings therein. The wedges are now slid from the rod. After the wedges have been so removed for future use, the plywood sheets may be slid from the rods. In the event the plywood sheets have been previously used and have bolt holes therein of greater diameters than the first stops, washers are provided that are mounted on the rod between the plywood sheets and first stops to prevent the first stops being forced through or into the bolt holes.

BRIEF DESCRIPTION OF THE DRAWINGS

FIG. 1 is a perspective view of the tie assembly removably supporting a pair of laterally spaced concrete form defining sheets in fixed positions relative to one another;

FIG. 2 is a perspective view of one of a pair of washers that is used with the assembly when it is mounted in bolt holes of previously used form defining plywood sheets;

FIG. 3 is a fragmentary combined side elevational and vertical cross-sectional view of a plywood sheet and end portion of the tie assembly; and FIG. 4 is a transverse cross-sectional view of the tie assembly taken on the line 4—4 of FIG. 3.

DESCRIPTION OF THE PREFERRED EMBODIMENT

The tie assembly A as shown in FIG. 1 is adapted to maintain a pair of plywood sheets B that have a pair of vertical and horizontal reinforcing members C secured thereto to define a concrete receiving space D therebetween.

Assembly A includes a rod 10 of substantial length that has two longitudinally spaced first stops 12 secured thereto and spaced inwardly from the ends 14 of rod 10. The stops 12 are illustrated as being of frusto-conical shape. The rod 10 has second stops 16 secured to the ends thereof. The pair of plywood sheets B are illustrated as of the previously used type that have transversely aligned bolt holes 18 therein that are of a diameter greater than that of the first stops 12.

A pair of washers G are provided that are illustrated in FIG. 1 as of generally rectangular shape. The washers G have L-shaped slots 30 therein of sufficient width as to be slidably engaged by the rod 10. The washers G are of greater transverse cross sectional area than that of the bolt holes 18. When the washers G are supported on the rod 10 as illustrated in FIG. 1 they bear against the pair of plywood sheets B to prevent the first stops 12 being moved through the bolt holes 18.

Assembly A includes a pair of wedges E of substantial width, with each wedge including a flat vertically positionable edge surface 22, and an upwardly and outwardly extending edge surface 24. Each wedge has an inverted key hole shaped opening F therein. Each opening F includes a first generally circular first portion 26 from which an elongate second portion 28 extends upwardly. The first opening portion 26 is of sufficient diameter as to permit a second stop 16 to be moved therethrough. The second opening portion 28 is of sufficient width as to slidably engage as end portion **10*a* of rod 10. Opening portion 10*a* has a width less than the diameter of second stop 16. When the wedges E are driven downwardly when disposed as shown in FIg. 1, the end portions 10*a* of rod 10 are forced upwardly in second opening portions 28. The second stops 16 are concurrently slidably engaged by the tapering surfaces 24** to force the wedges E inwardly for the plywood sheets B to be pressure gripped between the wedges and the washers G.

The pair of plywood sheets B are now held in fixed lateral spacing to permit fluid concrete (not shown) to be discharged into the space D. After the concrete (not shown) has set in space D, the wedges E are driven upwardly to dispose rod end portions 10*a* in the first opening portions 26. The wedges E may now be slid from the rod end portions 10*a*, and retained for future use. The pair of plywood sheets B and reinforcing members C may now be slid outwardly relative to the rod 10 and separated from the set concrete (not shown) in space D.

The assembly A is illustrated in FIG. 1 as used with previously used plywood sheets B that have bolt holes 18 therein. If the plywood sheets B are new extensions of bores 20 will be formed therein. The bores 20 are of sufficient diameter as to permit second stops 16 to pass longitudinally therethrough, but are too small to permit longitudinal movement of first stops 12 therethrough. Thus it will be apparent that when new plywood sheets B are used it is not necessary to use the washers G.

The use and operation of the tie assembly A has been explained previously in detail and need not be repeated.

What is claimed is:

1. In combination with a concrete receiving form that includes two laterally spaced, reinforced plywood sheets that have been previously used in defining a form and that have a pair of transversely aligned bolt holes therein that previously received a relatively large diameter bolt, a device for removably maintaining said sheets in fixed relationship with one another to again define a concrete receiving form using said pair of aligned bolt holes, said device including:

a. a metallic rod of substantially greater length than the distance between said plywood sheets, said rod having oppositely disposed end portions that extend through said pair of bolt holes and outwardly therefrom;

b. two longitudinally spaced first stops secured to said rod and inwardly from said ends thereof, said stops of less transverse cross sectional area than that of said bolt holes, said stops adjacent interior surfaces of said two plywood sheets;

c. a pair of rigid washers of greater transverse area than that of said bolt holes, said washers having L-shaped slots therein that slidably engage said rod, said washers when so engaged transversely supported on said rod, with each of said supported washers disposed between one of said first stops and said plywood sheet most adjacent thereto to prevent said first stops being drawn into said bolt holes when said pair of wedges are moved downwardly relative to said rod;

d. a pair of second stops secured to said ends of said rod, said second stops having a transverse area that is less than that of said bores; and e. a pair of rigid wedges, each of said wedges including an elongate flat vertically positionable first edge surface and a second upwardly and outwardly extending second edge surface, and a transverse opening of inverted keyhole shape that extends between said first and second edge surfaces, said opening including a first portion through which one of said second stops and a section of said rod adjacent thereto can be moved and a second elongate portion that extends upwardly from said first portion, said second portion having a width greater than the diameter of said rod but less then the diameter of said second stop, said wedges when driven downwardly having said rod sections enter said second opening portions as said second stops slide upwardly on said second end surfaces to force said wedges towards one another, with each of said wedges cooperating with said first stop and the one of said washers most adjacent thereto to grip one of said plywood sheets therebetween and said two plywood sheets being held in fixed lateral spacing to permit fluid concrete to be poured therebetween, said wedges capable of being removed from said rods after said concrete has set by driving said wedges upwardly to dispose said rod sections in said first opening portions, and said wedges then being movable outwardly from said rods together with said plywood sheets for reuse in providing another form to receive concrete to define a concrete wall.

* * * * *